United States Patent [19]

Maxwell

[11] 4,135,020

[45] Jan. 16, 1979

[54] PROCESS FOR PRODUCING ART WORKS AND RESULTING PRODUCT

[75] Inventor: Paul E. Maxwell, Carrollton, Tex.

[73] Assignee: Elevations/Design, Inc., Dallas, Tex.

[21] Appl. No.: 783,329

[22] Filed: Mar. 31, 1977

Related U.S. Application Data

[60] Division of Ser. No. 552,323, Feb. 24, 1975, abandoned, which is a continuation-in-part of Ser. No. 443,313, Feb. 19, 1974, Pat. No. 3,925,586.

[51] Int. Cl.[2] ..... B32B 3/10; B32B 1/00; B05C 1/00; B05C 5/00

[52] U.S. Cl. ..... 428/131; 428/187; 118/212; 118/213; 118/301; 427/282

[58] Field of Search ..... 101/127, 127.1; 427/143, 259, 272, 282; 118/504, 505, 301, 406, 211, 212, 213; 428/131, 134, 135, 152, 156, 179, 187

[56] References Cited

U.S. PATENT DOCUMENTS

| | | | |
|---|---|---|---|
| 911,033 | 2/1909 | Ferguson | 427/259 X |
| 1,808,986 | 6/1931 | Hunter | 101/127 |
| 3,061,500 | 10/1962 | Kreier | 428/187 X |
| 3,231,454 | 1/1966 | Williams | 428/134 X |
| 3,401,075 | 9/1968 | Jackson | 428/131 X |
| 3,724,420 | 4/1973 | Quinn | 118/505 |

*Primary Examiner*—George F. Lesmes
*Assistant Examiner*—Daniel R. Zirker

[57] ABSTRACT

Art is stencil cast using modeling paste directly onto a substrate door, a wall section, such as, a panel, a rigid or flexible vinyl sheet or similar materials, which acts both as a base for the mold and as the substrate for permanent retention of the cast-in-place art work.

1 Claim, 26 Drawing Figures

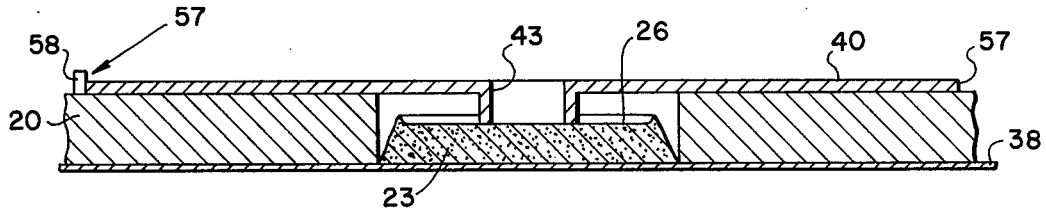
FIG. 18
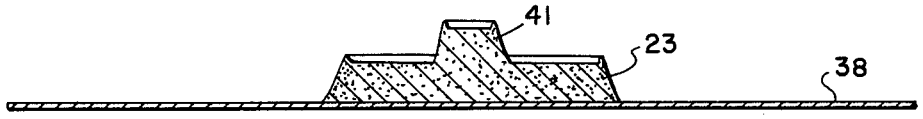
FIG. 19
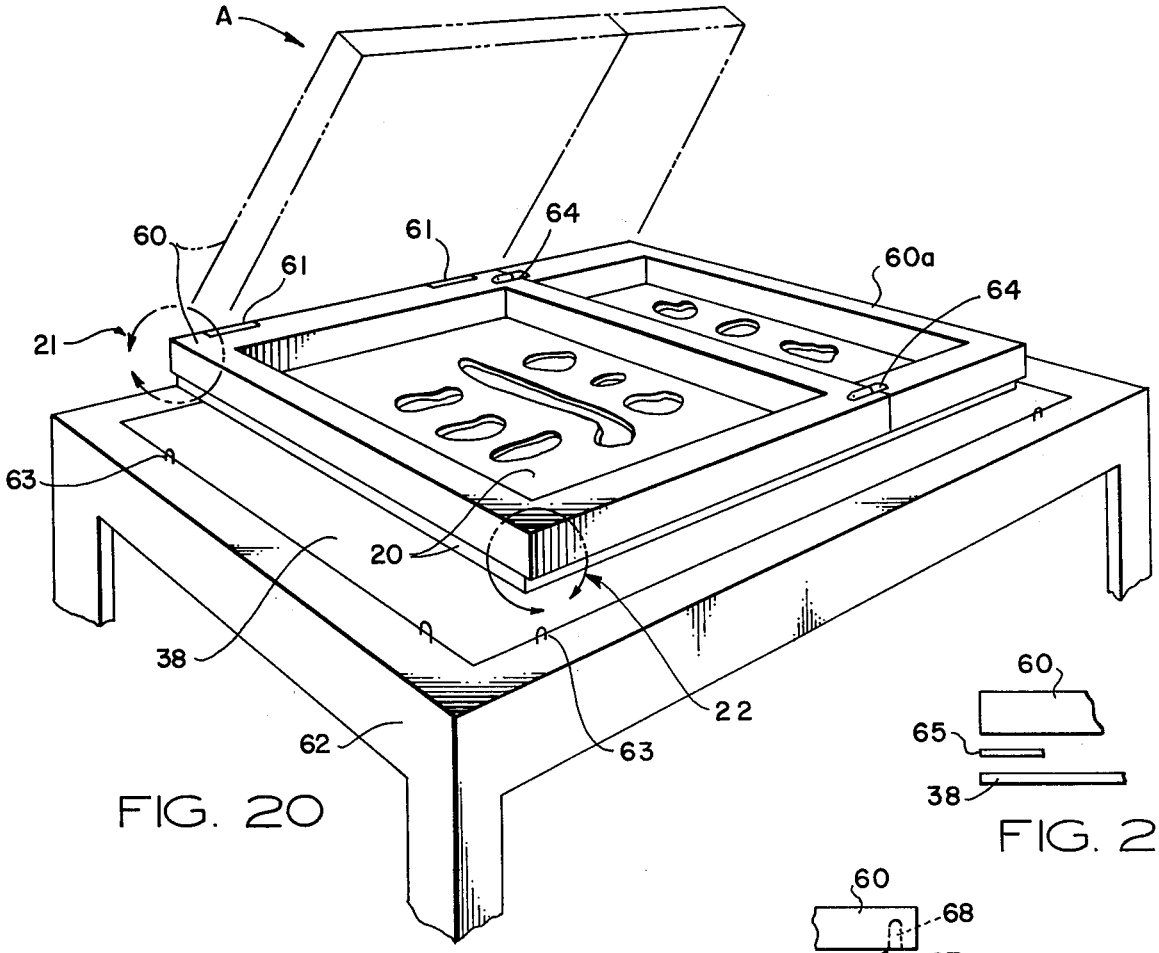
FIG. 20
FIG. 21
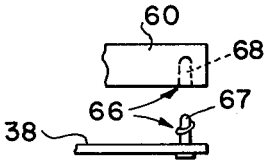
FIG. 22

PROCESS FOR PRODUCING ART WORKS AND RESULTING PRODUCT

This application is a divisional of copending application, Ser. No. 552,323, filed Feb. 24, 1975, now abandoned, which in turn is a continuation-in-part of application, Ser. No. 443,313, filed Feb. 19, 1974, now U.S. Pat. No. 3,925,586.

BACKGROUND OF THE INVENTION

1. Field of Invention

This invention relates to the field of bas-relief art, and to methods and processes for preparing and using such art.

2. Description of the Prior Art

Bas-relief art has been previously prepared by carving directly into a surface or by pouring into a suitable mold.

The carving or sculpturing technique goes back to ancient times, and its exact origin would be difficult to trace, but it has been used with both hard and soft surface materials and is well known in the decorative arts.

Molding a bas-relief is a more recent technique, which can be examined with reference to prior art U.S. Pat. Nos. 3,322,609 to Vida; 3,444,032 to Kreier; 3,663,349 to Venturino; 3,269,886 to Dellanbaugh, and 3,712,825 to Yocum.

In the above patent to Vida, a separate mold unit is required into which a building facing material of a mixture of thermosetting resin, silica sand, crystalline alumina, or other translucent grains is deposited. His finished product is flexible at the grout lines only, and all of his rigid members are substantially the same height. The process steps employed by Vida number at least fourteen (compared to applicant's eight) and are intricate and expensive to accomplish his result, whereas applicant's process, by comparison is extremely simple, economical, and expedient to accomplish the applicant's result.

The patent to Kreier discloses a method and resulting article using a slurry of metal powder and binder deposited in a flexible mold and then flame curing the slurry to provide a porous metallic pattern on a rigid multilayer panel. In contradistinction, in one embodiment, the applicant's non-metallic product is formed on a very flexible substrate for the purpose of shaping the substrate to an architectural column or similar support.

The patent to Venturino discloses a wall panel having a central layer of fabric with veneer wood or imitation leather glued to one side, and provided on the other side with plastic secured thereto by hot-pressing to impart a geometric embossed form to the panel. Applicant's architectural art section, in contrast, requires no expensive hot-press machines or dies, and uses economical stencils that may be quickly and manually changed to incorporate appropriate new designs, if desired.

The patent to Dellenbaugh discloses a masonry item and a method primarily intended to produce a small decorated tile by casting wet cementious material into a mold lined with a then smooth surfaced water swellable film. The wet material transfers water to the film which expands upwardly into the cementious material in the form of random wrinkles. When the cementious material has set and is removed from the mold, it will show on its face the identical design of the wrinkles. While this is an ingenious approach to creating a novel random design on relatively small sections of tile, it differs markedly from the applicant's process and resulting product of extremely large flexible material and deliberate designs of creative architectural art that may be reproduced indefinitely.

The patent to Yocum discloses a simulated masonary wall panel that is formed by first coating the panel with a base coat to resemble mortar and then spraying a finish coat through a mask to protect the simulated mortar joints. When the mask is removed, the finish coat resembles brick or other masonary stone. The applicant's process specifically avoids using a rigid or brittle (when set) medium and deliberately avoids simulating masonary stone so that an attractive, artistic presentation is obtained.

SUMMARY OF THE INVENTION

A principal object of this invention is to provide a simple, straight forward and economical process for producing large segments of architectural and creative art.

Another object is to provide such a process that is repeatable for an indefinite number of times so that consistent architectural and creative art is produced.

A further object in one embodiment is to provide a process for making a resulting decorative product which is not designed to hang on a wall, but is the wall itself.

And, another object is to provide an architectural art product that comprises a large section of flexible material which is adapted to adher to curved construction sections, such as a column, and provide post-construction bas-relief patterns in the columns.

An additional object is to provide a method of producing an entire wall section containing its own inherent decorative design from a single mold that may be used over and over again without damage to the mold or loss of quality in the resultant product.

And yet another object is to provide a reproducible process that will provide architectural art designs of raised islands of rustic contour and varying heights selectively.

An additional object of this invention is to incorporate into this creative art process additional refinements that will produce aesthetic and unique effects in the finished product with a minimum of hand labor, and that will permit registration of the stencil on a partially completed art product to produce additional designs thereon.

A further object is to provide fixed and removable attachments to a stencil used in making art products so that unique effects are automatically created selectively by simply removing the stencil art product cast therein.

Another object is to provide a stencil casting method wherein designs in the stencil are reproduced directly onto columns through a circular or other shaped stencil that engages the inner periphery of the circular or other shaped mold used to pour the column.

BRIEF DESCRIPTION OF THE DRAWINGS

FIG. 18 is a cross-sectional view of a modified embodiment of the stencil shown in FIGS. 12 and 13 and used in conjunction with the principal stencil.

FIG. 19 is a side elevational view of the cast in place medium of FIG. 18 after the supplemental casting using the stencil of FIG. 18.

FIG. 20 is a casting table used in one embodiment of the casting process of this invention.

FIG. 21 is a detail fragmentary end view of the corner shown in circle 21 of FIG. 20.

FIG. 22 is a detail fragmentary end view of the corner shown in circle 22 of FIG. 20.

DESCRIPTION OF PREFERRED EMBODIMENTS

This invention is particularly adapted to be fabricated of initially pliable material such as modeling paste, and one specific acrylic-polymer modeling paste that is satisfactory for this purpose is identified as No. 7475 and is made by Hunt Manufacturing Co. of Statesville, N.C. To avoid confusion in the following specification, this material will be referred to as the "medium" and the substrate it is deposited on will be referred to as the "material".

Figure 1:
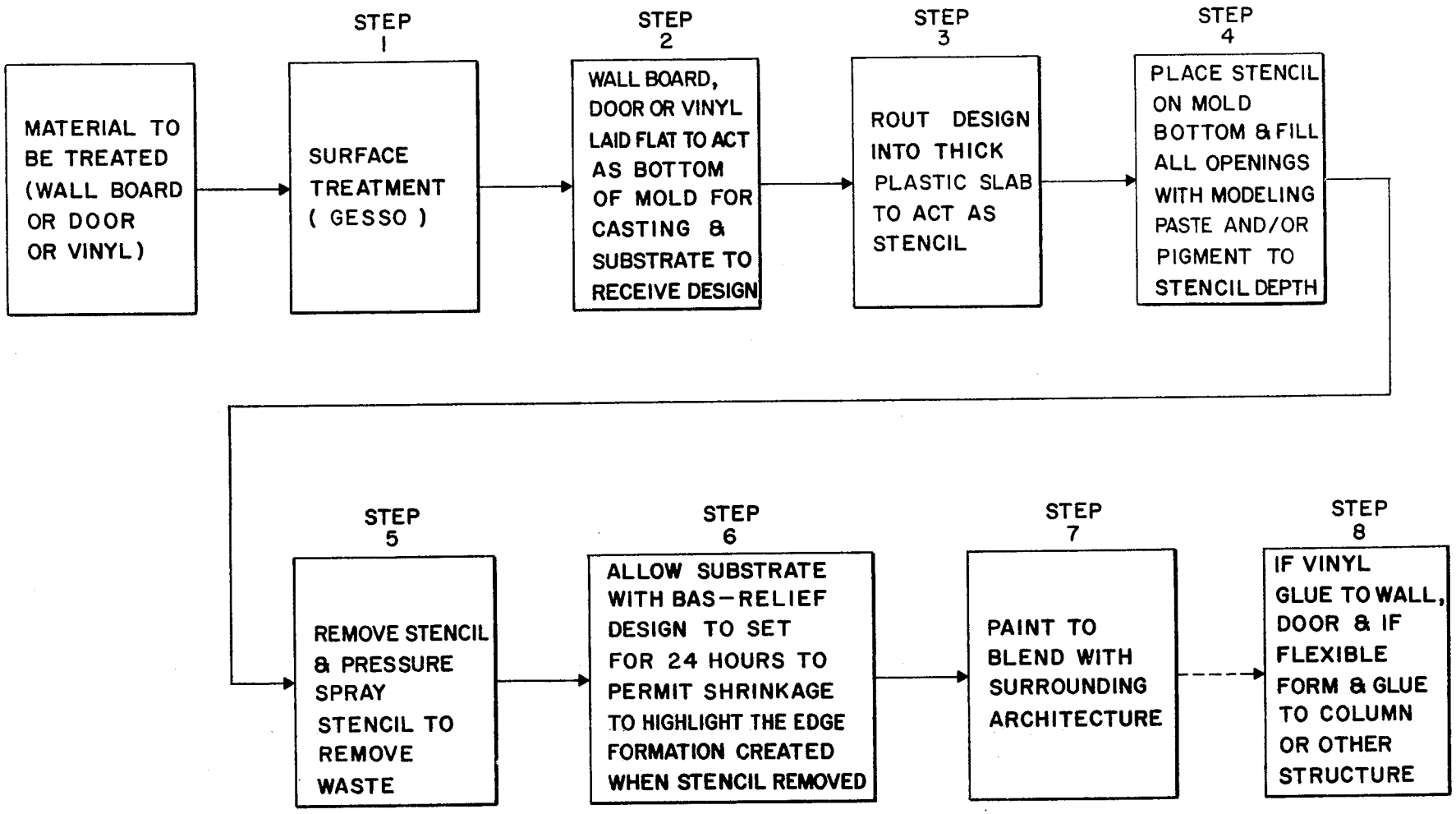
FIG. 1 is a block diagram of the process of this invention showing the steps and sequence in general outline.

Referring now to FIG. 1, the basic process is seen to comprise, initially obtaining the material to be transformed from its existing state, be it a plain section of building-size wall board, for example 4 by 8 feet or at least many square feet in area, an undecorated door, or a bare sheet of flexible vinyl material, or materials similar to the foregoing.

The first step in this overall novel combination process is a step that is helpful in some instances (but not essential), and that is to treat the surface of the material chosen with another ingredient to insure improved adhesion of the medium to the panel, door or wall board (surface treatment is not ordinarily used on vinyl materials). One suitable chemical ingredient for this purpose is gesso, defined in the dictionary as "Plaster of Paris, or gypsum, especially prepared for use in painting, etc." and made by several U.S. manufacturers, including Hunt Manufacturing Co. of Statesville, N.C. The surface treatment is accomplished by brushing on or otherwise applying a thin coating of the treating ingredient and allowing same to substantially dry on the surface of the material.

Step No. 2 in this process is to place the panel, door, wall board or vinyl in a horizontal, flat or contoured position on a stable surface so that the top surface of the material is either flat or corresponds to the contour of the stencil and becomes the substrate as well as acting as the mold bottom when the stencil casting takes place. (See FIG. 4).

The next step (3) shown in FIG. 1 may actually have occurred first, or it may not be necessary if a previous design is being repeated and its stencil is available. But initially this is a necessary step in the described process, so here the operator will start with a solid, relatively thick sheet (one-fourth inch and larger) of thermosetting plastic (as plexi-glass or equivalent) material and will route out the "negative" pattern of the desired design directly into and through the plexi-glass (see FIG. 5) to provide a stencil for the next process step. Plexi-glass has been found preferable to other stencil materials, such as wood, metal, masonite, etc. since it does not warp, is not moisture absorbent, and does not adhere to the medium. Other materials that have been found to be very satisfactory include thermosetting plastics, such as those manufactured by the General Electric Co. and sold under the trademark "LEXAN". The stencil is made in either a flat or contoured configuration, depending on its application.

In step No. 4, the operator places the routed out stencil onto and over the material (panel, wall, door, vinyl, column, or the like) which is now the substrate and during the casting process will act as the mold bottom. Next, the operator fills all the voids in the stencil with the medium (modeling paste, or the like), and using a squeegee over the surface of the stencil, forces the medium down to the full depth of each stencil opening. At this step, the modeling paste may be mixed with color pigment, either totally or selectively, to produce different raised islands of different colors.

The next step, No. 5, permits the operator to immediately remove the stencil as nearly vertical as possible. A parting agent, as disclosed in the Kreier patent is not necessary in this operation since the material of the stencil used minimizes adherence of the medium to it, and the slight adherence of medium to stencil which does take place results in a lip on the islands in the design, which is desirable. The stencil is then taken to a spray booth where water under pressure impinges on the surface of the stencil to completely remove the modeling paste, if any, remaining on the stencil.

The now completed design of the substrate with its raised islands of moist modeling paste is allowed to set for approximately twenty-four hours to permit shrinkage and semi-hardening of the islands. This step, No. 6, may be followed by placing another stencil, FIG. 18 in registration with and for a superimposed casting onto the present art product.

Step No. 7 is not usually followed if color pigments were added in step 4. Where uncolored modeling paste was used, the selective painting is done at this point or after installation to permit this new architectural art design to blend into and harmonize with the surrounding architecture.

Step No. 8 comprises installing the door, wall board or vinyl into the architectural structure to thus add creative beauty to the physical necessity. If the intended recipient location in the construction is curved or otherwise not flat, and the decorative substrate is vinyl, it may be glued to the construction member and will thus become a permanent and aesthetic part of the architectonic whole.

Figure 2:
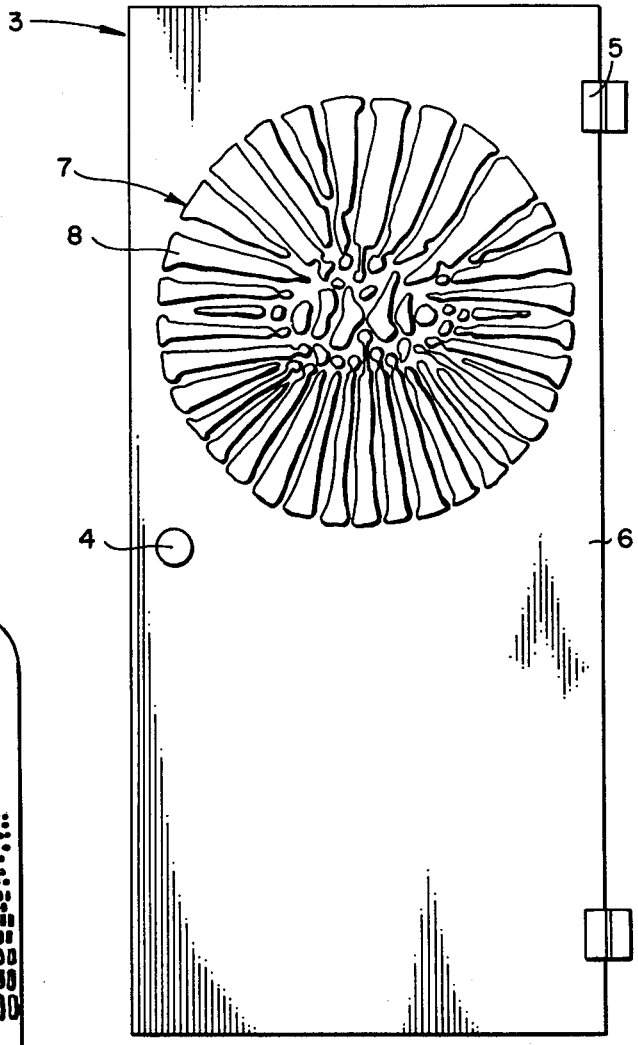
FIG. 2 is an example of architectural art produced by the process of this invention and resulting in a decorative door unit.
Figure 4:
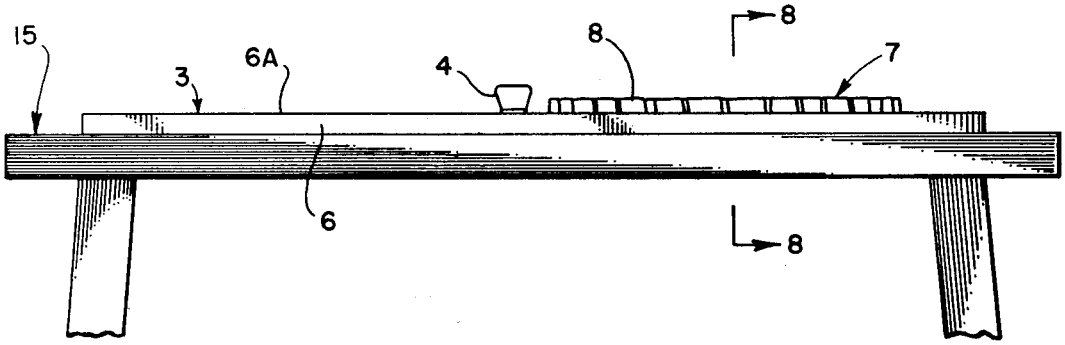
FIG. 4 depicts the door unit of FIG. 2 being subjected to this process.

Referring now to the other figures of the drawing, it will be observed that FIG. 2 is a plan view of the door 3 of FIG. 4 after it has been processed into a work of architectural art. This door 3 includes a knob 4 for opening and hinges 5 for hanging and a wood or other material body 6 from which the design 7 is raised. The design 7 comprises a series of raised islands 8 created by the foregoing process which at this point are an integral part of the door 3 in the same manner as if the whole door had been cast in place. This described bas-relief art could similarly be incorporated in a panel or a wall section using the same or varying design. In a commonalty of construction, the art design in doors and wall sections or superimposed panels would be compatible from an artistic sense using colors that blend and avoiding configurations that clash.

Figure 3:
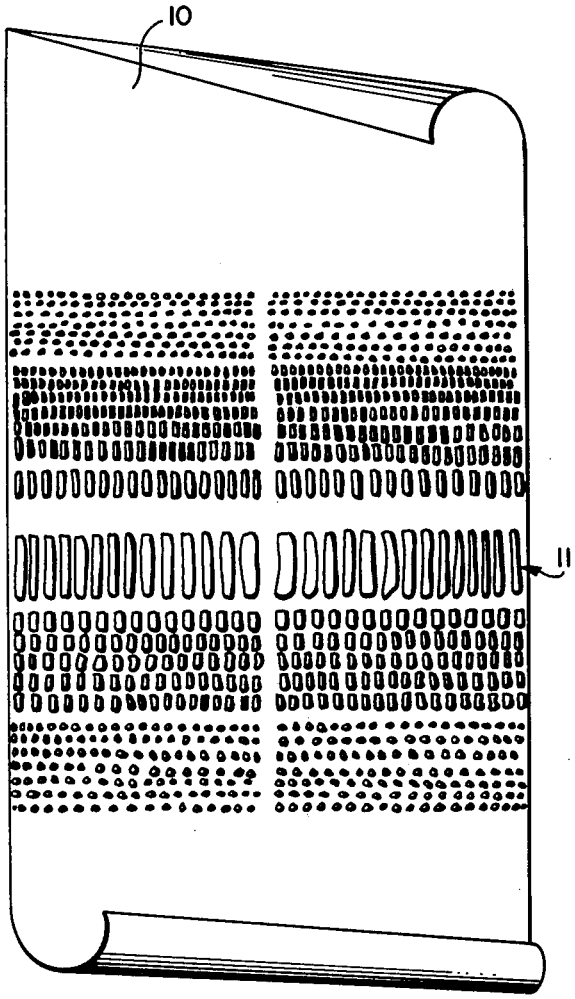
FIG. 3 is another example of architectural art resulting in a flexible section for direct application to building structures.

FIG. 3 represents an integrated section of flexible vinyl material 10 and an artistic design 11 which was likewise prepared by the described process. The advantage of incorporating an artistic design into flexible vinyl is that the now decorative material may be applied to previously plain and non-appealing construction members as a circular column and thus render it appealing and aesthetic, whereas installing bas-relief art by carving would be prohibitive from an economic viewpoint.

In FIG. 4, the door 3 of FIG. 2 is shown in a horizontal position on work table 15 where it is residing following the application of the process steps of FIG. 1. This is the position at which it may remain for twenty-four hours to permit the islands 8 of design 7 to set. Drying and curing may be expedited by use of heat.

Figure 5:
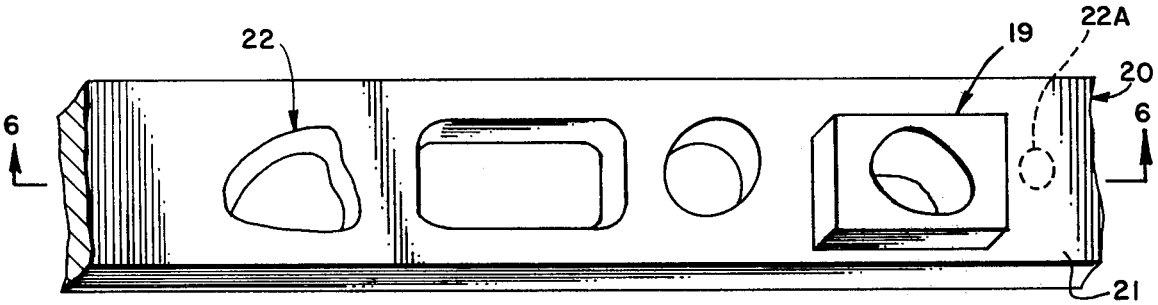
FIGS. 5 and 6 are plan elevational views of the stencil used to produce the product of FIGS. 7 and 8.
Figure 8:
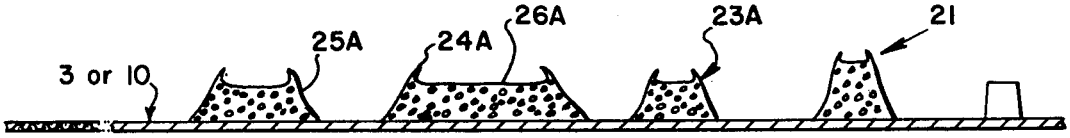

FIG. 5 is a modified fragmentary plan view of the stencil 20 used to create one specific design, identified at 21 in FIG. 8. The stencil 20 is made from a plexi-glass plate approximately one-fourth inch thick in which a plurality of openings or voids 22 have been routed and upon which elevated platforms 19 (integrally or as separate pieces) have been installed for purposes to be shown.

Figure 6:
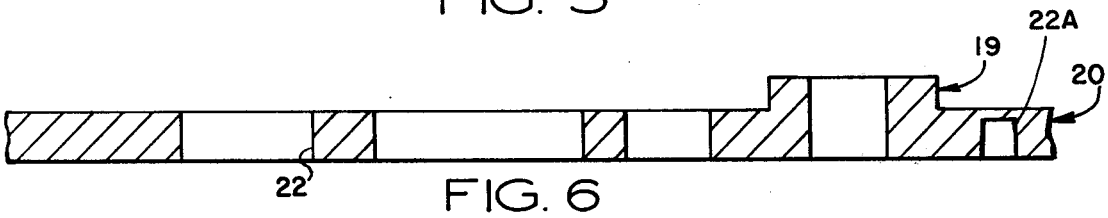

FIG. 6 is a cross-sectional view of the stencil of FIG. 5 taken along the lines 6—6 of FIG. 5. This cross-section illustrates that when stencil 20 is laid on the substrate material, such as door surface 6A, an open top mold is created having voids 22 that may be filled by the medium being cast to produce the decorative islands 23 of FIG. 7 when the stencil is removed. Islands resulting from the elevated platforms 19 are identified at 27. All of these islands have a unique configuration including a pointed lip 24, a slightly beveled sidewall 25, and a depressed top platform 26 shortly after the stencil casting process is completed. Also a part of this invention, though not shown in FIG. 6 is the technique, and resulting product, of using a blind stencil void 22A that opens to the bottom side of stencil 20. This blind hole void will conform in shape to raised design already on the substrate so that the stencil may lay flat on the substrate and not interfere with art work accomplished prior to the main modeling paste casting operation.

Figure 7:
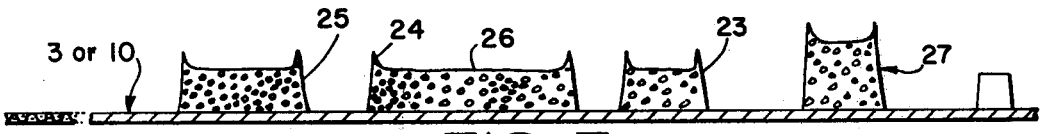
FIGS. 7 and 8 are enlarged fragmentary cross-sectional views showing the partially finished and finished architectural art product respectively.

FIG. 8 shows the resultant finished product of FIG. 7 after the modeling paste has set for a period of approximately twenty-four hours. The configuration of the islands by this time has changed into its permanent shape. These islands, identified at 23A of FIG. 8 are at different heights, size and shape as determined by the stencil mold of FIGS. 5 and 6 and their configurations after drying and curing for a short while are different from those shown in FIG. 7 which occur immediately after the mold 20 is lifted off of its substrate 3 or 10. This slightly beveled and slightly contracted shape of these islands assist in applying and removing the stencil since the fit is not tight and the drag between the walls of the voids 22 and the islands 23 is not excessive and does not encourage breaking or sticking. At the time represented by FIG. 8 the pointed lip 24 of FIG. 7 has dropped inward, the top platform 26 has contracted and shrunk to the levels shown at 26A, and sidewalls 25 have inclined inward to their contracted levels of 25A that have a greater inward slope than previously.

In the foregoing specification, reference was made to the condition whereat the modeling paste had "set" (Step No. 6, for example). In actual practice, while modeling paste "sets" and shrinks to its permanent shape after a pre-determined period, it does not harden or become brittle as cement does, but maintains a degree of flexibility, as does rubber. This feature is advantageous when the cast design is incorporated in a flexible vinyl substrate, since the islands are not damaged when the vinyl is curved, as for example around an architectural column.

Figure 9:
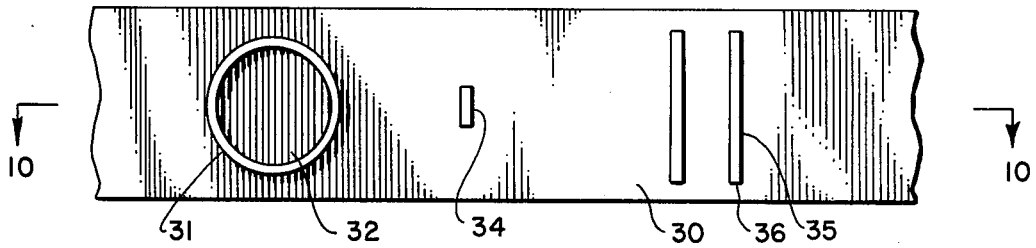
FIG. 9 is a bottom plan view of a fragmentary supplemental stencil that may be used to obtain additional artistic effects following use of this principal stencil.
Figure 10:
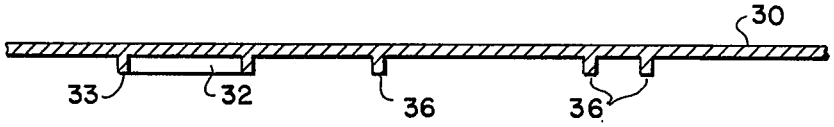
FIG. 10 is a cross-sectional view taken along the lines 10—10 of FIG. 9.
Figure 11:
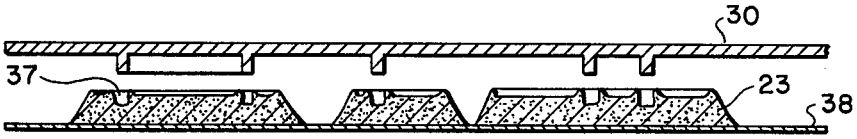
FIG. 11 is a cross-sectional view showing the stencil of FIGS. 9 and 10 in use on a section of cast in place architectural art.

Referring now to the stencil embodiments shown in FIGS. 9–19, it will be observed that these stencils are used to impart additional refinements to the products made by the initial stencil casting process. In FIGS. 9–11, a supplemental stencil 30 includes a geometrical figure 31 depending from the bottom surface of the stencil 30. The blind hole 32 within the figure 31 may be used either to surround an already cast in place island (23 or 27 of FIG. 7) or the exposed edge 33 may be used to impress the geometric design of figure 31 into the previously cast, but not fully set island. Similarly, dots 34 and lines 35 present an exposed impressing edge 36 to accomplish the impression of their shapes into islands 23 when pressure is applied to the top side of stencil 30. The impressions left in the cast islands 23 are identified at 37. The ultimate effect on the finished art work is the presentation of rugged beauty. The substrate in this instance is identified as panel 38.

Figure 12:
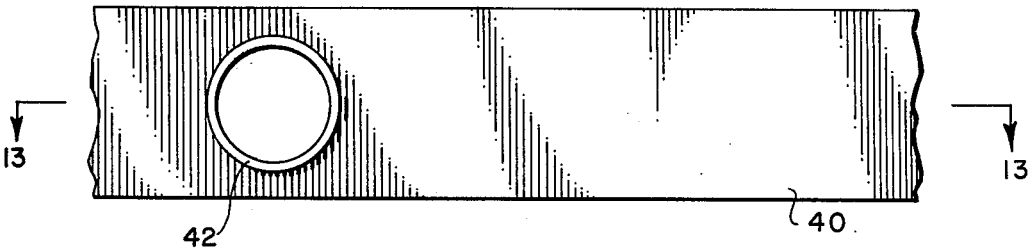
FIG. 12 is a bottom plan view of a fragmentary supplemental stencil that may be used for casting additional levels to a previously cast medium.
Figure 13:
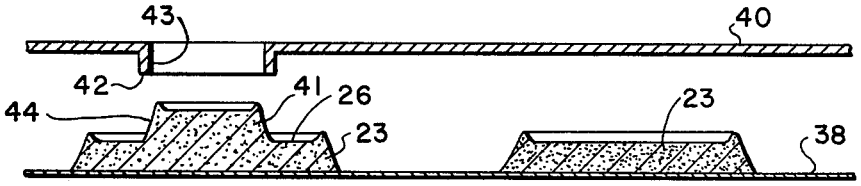
FIG. 13 is a cross-sectional view showing the stencil of FIG. 12 following its use on a previously cast medium.

FIGS. 12 and 13 depict the use of a supplemental stencil 40 which is used to cast a second island 41 on top of an existing island 23. This is accomplished by laying stencil 40 over an already cast on panel 38 until the edge 42 of through opening 43 engages the top 26 of island 23. At this point the casting medium is applied to surface 26 through the opening 43 until the desired height is obtained. After the prescribed interval for the medium being worked, the stencil 40 is removed by lifting in a direction normal to panel 38. The depth of opening 43 must be such as to obtain the desired height of the second tier island 41 and also so that the bottom side of panel 40 will be clear of the lips 24 of the first islands 23. Stencils 30, 40, et al, must also include additional openings if islands 27 are present and must be protected, as is true with all the safe-guards mentioned for different stencils if the conditions are appropriate.

Figure 14:
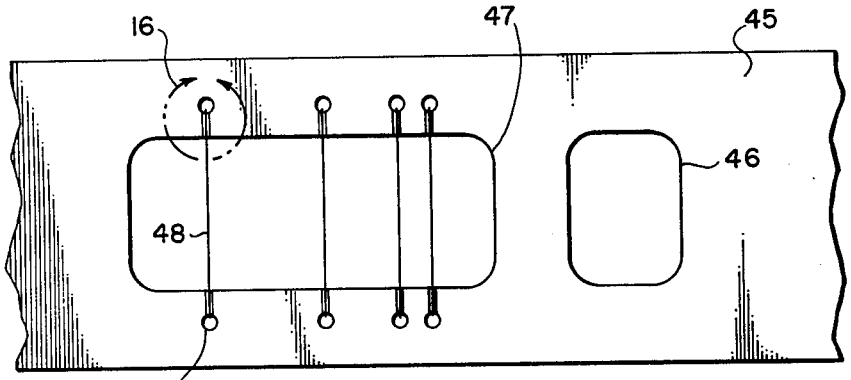
FIG. 14 is a bottom plan view of an additional supplemental stencil.
Figure 15:
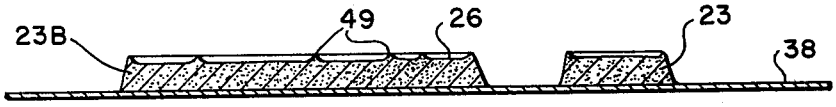
FIG. 15 is a cross-sectional view of a cast medium after it has been worked by the stencil of FIG. 14.
Figure 16:
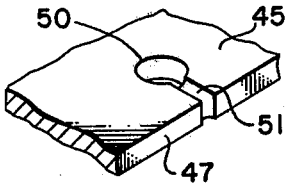
FIG. 16 is an enlarged fragmentary detail perspective view of an eyelet shown in circle 16 of FIG. 14.

FIGS. 14–16 depict the use and result of yet another supplemental stencil 45 which includes openings 46 and 47 which may be plain as 46 to permit casting of an island 23 therethrough or surround a previously cast island, or which may include additional forming members as the wires 48 of opening 47. The island 23B may be cast prior to the use of stencil 45, or it may be cast by using stencil 45; in either event the desired effect is the rippled surface tips 49 that appear on the top 26 when stencil 45 is removed from its contact with island 23B. The metal wires, or other filaments, such as nylon cord, 48 are installed over the opening 47 by looping through the openings 50 on opposite sides of opening 47. The wire 48 may be double looped and tied adjacent either side or intermediate the depth, of stencil 45, or the wire may be used as a single wire between corresponding openings 50 and tied along the top, bottom or intermediate the depth, as with the double wire. The preferred construction is for the wire 48 to lie in grooves 51 of both the top and bottom surfaces of stencil 45 and be tied to itself immediately adjacent the center area between the grooves so that a single wire stretches across the opening 47. In this manner the groove or indentation 51 houses the filaments 48, so that the bottom of stencil 48 may rest flat on the surface of substrate 38. The rippled surface tips 49 are directed in thin raised lines on the surface 26 to correspond in number and direction to the filaments 48.

Figure 17:
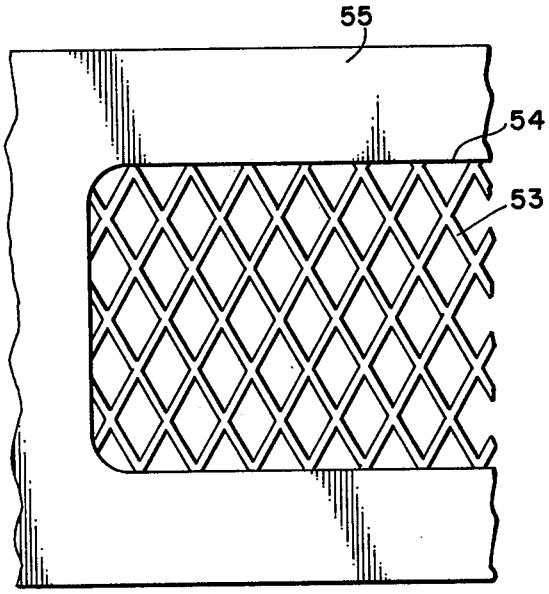
FIG. 17 is an enlarged fragmentary detail plan view of a variation of the construction shown in FIG. 14.

Another technique that provides yet another surface effect is practiced using the expanded metal screen or mesh to provide yet a different surface texture. FIG. 17 shows the construction of an expanded metal 53 inset into the opening 54 of stencil 55.

FIGS. 18 and 19 show construction and technique similar to that disclosed by FIGS. 12 and 13; but in this instance accurate alignment and registration of the second tier pattern is assured by using the stencil for the first tier as the point of reference. The stencil 40 is so constructed that when its leading edge 57 abuts against stop lugs 58 that are upstanding from the top surface of initial stencil 20, the opening 43 will be in accurate alignment with the correct location on the surface 26 that second tier island 41 will be centered or otherwise properly located on island 23.

Figure 23:
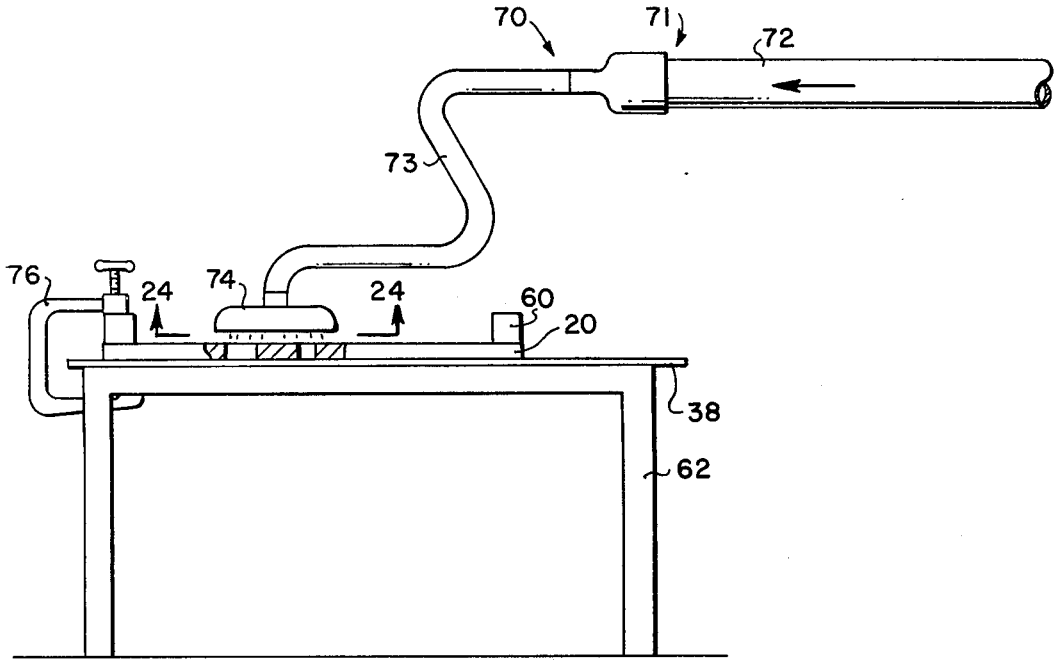
FIG. 23 is a diagrammatic view of the table of FIG. 20 in use in an automated production operation.
Figure 24:
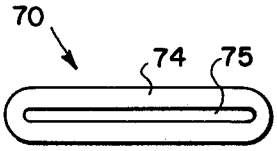
FIG. 24 is a bottom view of the squeegee tool of FIG. 23 taken at the lines 24—24.

FIGS. 20–24 show apparatus employed to automate the production of the products of this invention. FIG. 20 discloses a casting table on which a stencil holding frame 60 is attached by means of hinges 61. When the frame 60 is raised to position A, a stencil 20 may be attached to the underside by any suitable fastening technique. Two such techniques are shown in FIGS. 21 and 22. While frame 60 is in the A position, the substrate 38 may be laid or automatically fed onto the table 62. Stop lugs 63 may be used to position the substrate and insure the accuracy of repeated castings made from the same stencil in an automated production process. Once the substrate 38 has engaged stop lugs 63, the frame 60 is lowered until it and the attached stencil 20 rest on the substrate in their proper orientation. At this point the casting medium may be applied by hand or trowel, or the operation may be carried out by an automatic self-feeding squeegee 70 such as shown in FIGS. 23 and 24. If an extra long stencil is accommodated on table 62, an extension frame 60*a* may be releasably attached to main frame 60 by quick fastener means 64. In either usage the stencil 20 is attached to the underside of frame (s) 60, 60*a* by an appropriate manner, such as shown in FIGS. 21 and 22 to be an adhesive strip 65 that has adhesive on both sides, or by bayonet-type fittings 66 (comprising prong 67 and opening 68) that may be forceably inserted and forceably removed at appropriate locations around the periphery of frame 60.

In FIG. 23, it is seen that the work table 62 containing frame 60 and stencil 20 and onto which table the substrate 38 is fed, is located adjacent a casting medium delivery system 71 so that automated production techniques may be utilized to advantage in manufacturing the art products described herein. Modeling paste, if the medium used, is fed, under pressure, through a supply pipeline 72 that connects to a flexible hose section 73 that terminates in a pressure squeegee head 74 which dispenses modeling paste under pressure through an elongated port 75 onto the top surface of stencil 20. The pressure head 74 is then held adjacent stencil 20 and moved back and forth across the stencil 20 until all the cavities 22 therein have been filled with modeling paste. A quick release latch 76 may be employed to hold frame 60 and stencil 20 firmly against the substrate 38 and table 62, but in most instances the weight of the frame will be sufficient.

Figure 25:
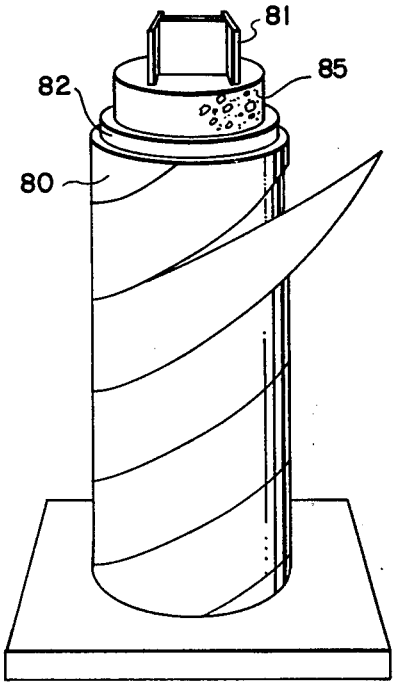
FIG. 25 is a pictorial view of a unique method of casting a decorated column.
Figure 26:
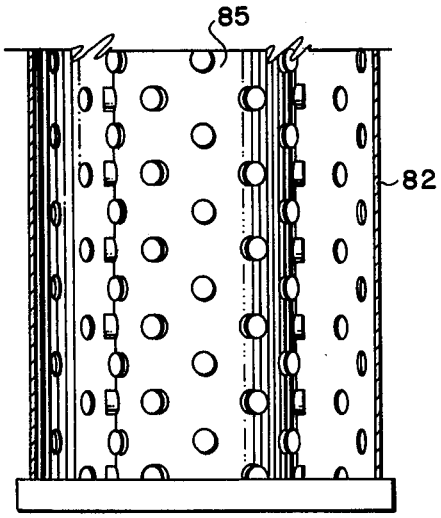
FIG. 26 is a pictorial view of the column of FIG. 25 after the casting is complete and the stencil is being removed.

In FIGS. 25 and 26, a method and apparatus is shown by which the medium may be cast in place and form both the structural column itself and the decorative exposed surface simultaneously. FIG. 25 shows a paper mold 80 that is formed up in the usual way to pour concrete columns, in fact concrete would be suitable medium in this instance. Inside the paper mold, reinforcing or structural steel 81 is placed. At this point the method is conventional. However, the next step is to insert a circular stencil 82 to snugly engage the inner periphery of the paper mold. Concrete or other media is poured into the open top of the paper mold and the stencil and the medium moves into the openings 22. When he medium has set, the paper mold 80 is peeled off in a well-known manner and the stencil 82 is opened as shown in FIG. 26 and the cast in place decorated column 85 is exposed. If modeling paste is to be used as the medium it may be pumped into the mold under pressure, or the paper may be omitted entirely and the modeling paste applied through both the top and outside of the stencil to produce the decorated column. Or a vinyl covered exisiting column may have the stencil wrapped around its periphery and then the casting of modeling paste may be made through the stencil and onto the vinyl which is glued to the column.

From the foregoing description and examples, it will be seen that there has been provided a method and a device that substantially fulfills the objects of this invention as set forth herein. The invention is not limited to the exemplary construction herein shown and described, but may be made in many ways within the scope of the appended claims.

I claim:

1. A stencil for making a modeling paste art product, comprising:

a. a flat thick sheet of a thermosetting plastic for overlaying a relatively thin flexible material substrate in close juxtaposition thereover, b. said body defining an open cavity thru which modeling paste may be cast for adherence to and as an island on the substrate, c. said body also defining a closed cavity opening toward the substrate only, to enclose previously cast islands, d. individual wire filaments extending independently of each other across said open cavity, and e. means to secure said filaments to said body, f. whereby the combination of the above structures will provide a stencil capable of producing multiple cast islands of differing heights if modeling paste on a thin flexible substrate wherein at least one of the islands will have a pointed lip around its periphery and rippled surface tips across its top surface when said stencil is removed from the substrate.

* * * * *